United States Patent [19]

Borrows

[11] 4,317,351

[45] Mar. 2, 1982

[54] METHODS OF AND/OR APPARATUS FOR PUNCHING HOLES IN SHEET METAL

[75] Inventor: John G. Borrows, Auckland, New Zealand

[73] Assignee: Fisher & Paykel Limited, Auckland, New Zealand

[21] Appl. No.: 129,250

[22] Filed: Mar. 11, 1980

[30] Foreign Application Priority Data

Mar. 12, 1979 [NZ] New Zealand ..... 189886

[51] Int. Cl.[3] ..... B21D 28/26

[52] U.S. Cl. ..... 72/186; 83/345

[58] Field of Search ..... 72/185, 186; 83/176, 83/308, 343, 344, 346, 345, 678, 685; 29/163.5 R

[56] References Cited

U.S. PATENT DOCUMENTS 3,142,216 7/1964 Rupnow ..... 83/308

3,738,209 6/1973 Davis ..... 83/308

FOREIGN PATENT DOCUMENTS 920443 3/1963 United Kingdom ..... 83/343

*Primary Examiner*—Lowell A. Larson

*Attorney, Agent, or Firm*—Holman & Stern

[57] ABSTRACT

A machine for punching holes in sheet metal has a punch roller carrying a plurality of punches and a back up roller having a groove therein which has a bottom at a predetermined depth in the back up roller. Its method of use is to run sheet metal through the nip between the two rollers so that the punches punch out slugs of metal so that a point on each slug bears against the bottom of the groove which acts as a pivot point on which the slug pivots to cause the slug to be completely freed from the parent metal by the further action of the punch.

12 Claims, 3 Drawing Figures

METHODS OF AND/OR APPARATUS FOR PUNCHING HOLES IN SHEET METAL

This invention relates to methods of and/or apparatus for punching holes in sheet metal and has been devised particularly, though not solely, for punching holes in perforated tubs for automatic washing machines.

BACKGROUND OF THE INVENTION

Hole forming machines using a rotatable member carrying punches and a back up wheel which carries a continuing slug receiving slot have been disclosed in U.S. Pat. No. 3,142,216.

In such a machine complete separation of the slug punched from the hole in the parent metal is not always effected because the punch causes the slug to hinge at a hinge point which hinge point is clear of the punch path because of adjacent deformation of the parent metal.

It is an object of the present invention to provide a method and/or apparatus for punching holes in sheet metal which will at least provide the public with a useful choice.

BRIEF SUMMARY OF THE INVENTION

Accordingly in one aspect the invention consists of a method of punching holes in sheet metal using a punching roller having a series of radial punches on a cylindrical surface thereof and a backing roller, the backing roller having for each row of holes to be made two raised lands and a groove therebetween, the groove having a bottom at a predetermined depth, said method comprising the steps of running sheet metal through the nip between the punching roller and the backing roller so that each punch in the punching roller causes a slug of metal to be cracked out of the parent metal until one edge of said slug of metal engages the bottom of the groove at a pivot point whereupon the slug of metal hinges on said pivot point causing complete separation of the slug of metal from the parent metal.

In a further aspect the invention comprises apparatus for punching holes in sheet metal, said apparatus comprising a frame, a punching roller mounted on a shaft rotatable in said frame and carrying a plurality of punches on the cylindrical surface thereof, a backing roller mounted on a shaft rotatable in said frame and spaced away from the punching roller by a distance substantially equal to the thickness of metal through which holes are to be punched, said backing roller having for each row of holes to be punched a groove between lands or annular rings thereon said groove having a base disposed relative to the length of said punches such that on a sheet of metal being passed through the nip between said punching roller and said backing roller each punch punches a slug of metal so as to be cracked out of the parent metal until one edge of the slug contacts the base of said groove at a point of contact which acts as a pivot point on which the slug pivots to cause the slug to be removed completely from the parent metal by further action of the punch.

To those skilled in the art to which this invention relates many changes in construction and widely differing embodiments and applications of the invention will suggest themselves without departing from the scope of the invention as defined in the appended claims. The disclosures and the description herein are purely illustrative and are not intended to be in any sense limiting.

BRIEF DESCRIPTION OF SEVERAL VIEWS OF THE DRAWINGS

One preferred form of the invention will now be described with reference to the accompanying drawings in which.

DETAILED DESCRIPTION ACCORDING TO THE INVENTION

Figure 1:
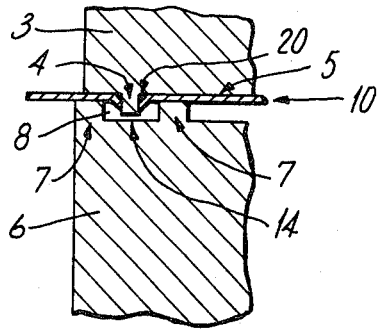
FIG. 1 is a diagrammatic part cross section of a pair of rollers having sheet metal therebetween with a punch of one roller passing through the sheet metal.
Figure 2:
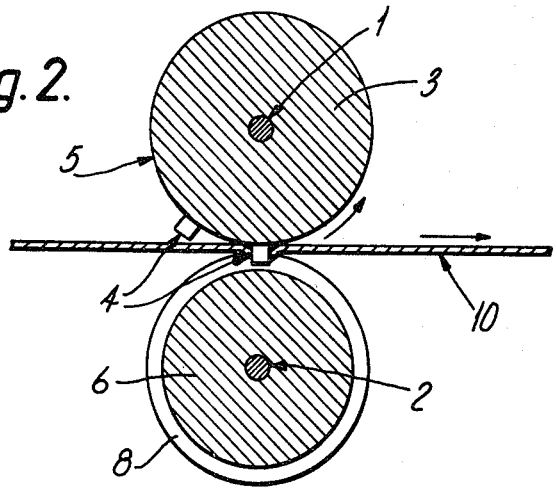
FIG. 2 is a partially diagrammatic side view of apparatus according to the invention and, FIG. 3 is an enlarged view showing the punching action according to the invention.

Referring to the drawings apparatus is constructed as follows:

A frame (not shown) is provided having bearings and shafts 1 and 2 run in these bearings. The shaft 1 carries a punching roller 3 having a plurality of radial punches 4 on a cylindrical surface 5 thereof. A backing roller 6 has a pair of lands 7 arranged either side of a groove 8. The groove 8 has a base 14. The rollers 3 and 6 are spaced apart by a distance sufficient to receive therebetween a sheet of metal 10 in which holes are to be punched as will be described shortly. Although the rollers 3 & 6 are shown as having only one row of punches and only some of the punches on the circumference of roller 3 are shown, it will be apparent that the rollers may have any number of rows of punches arranged longitudinally along the length of the cylindrical roller 3. The rollers 3 & 6 may be driven either by exerting tension on the sheet of metal 10 and depending on the engagement of the rollers 3 & 6 therewith or by driving one or both, preferably the punch roller 3 with any convenient form of drive.

Figure 3:
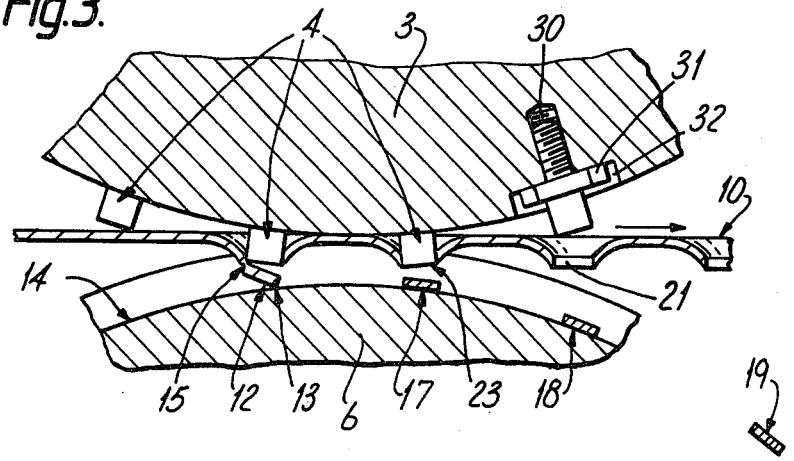

The operation of the apparatus is as follows:

As the punches 4 are moved over the surface of the piece of metal 10 placed in the nip between the cylindrical surface of the roller 3 and the cylindrical surfaces of the lands 7, roller 3 which as stated is driven by any suitable driving source causes the sheet of metal to pass through the nip and at the same time the punches 4 will be caused to enter the surface of the metal 10. Reffering now to FIG. 3, a punch 4 is shown as having partially cracked out a slug of metal 12 until a point 13 on the slug of metal contacts the surface 14 which is the base of the groove 8 on the backing roller 6. When this occurs the point 13 of the slug 12 acts as a pivot and the rear edge 15 of the punch 4 exerts a force causing the slug to pivot on pivot 13 thus breaking off the cracked out portion and separating the slug 12 from the parent metal at 15, as may be seen at 17 in FIG. 3. The consequence is that the slug of metal is completely free from the parent metal 10 and may fall away as shown at 18 and 19 (FIG. 3). The result is a clean cut hole in a depression 20 (FIG. 1). The depression is due to the lack of support for the metal 10 and to make the depression reasonably symmetrical the groove 8 is made substantially wider than the width of the punches 4.

If the engagement of the slug 12 with the base 14 of the groove 8 then complete detachment of the slug 12 from the parent does not always occur because the punch pushes the slug away, the slug 12 hinging at the point 15 and in many cases the hinging metal does not positively break away, the punch 4 passing through the hole 21 while the higher point 15 is to one side of the punch. It is to be noted that the punches 4 may be shaped in cross section to any convenient shape to form e.g. round holes or elongated slots and that the faces 23 of the punches 4 are preferably simple flat faces normal to the punch length simplifying sharpening of the punches. The punches may be screwed into female threaded holes 30 in the roller 3 with fixed nuts 31 provided in recesses 32 in the roller bearing against removable shims (not shown) to adjust the length of the punch projections relative to the base 8.

The present invention has been developed particularly though not solely for use in perforating the perforated drum of an automatic clothes washing machine and as a result of the invention such perforations can be made simply and quickly by running a sheet of metal through a machine constructed as above described and having the necessary numbers of rows of punches and backing depressions.

Furthermore the invention obviates the requirement of a multiplicity of close fitting punches and dies thus reducing both capital and maintenance costs.

Punch lengths, groove depths, and groove widths are selected to obtain complete slug separation having regard to the particular material characteristics and metal thickness being used.

What is claimed is:

1. A method for punching holes in a parent sheet metal employing a rotatable punching member including a series of punches and a backing roller including at least one groove between lands, said groove being aligned with said punches and having a base surface of predetermined depth relative to said lands, said method comprising the steps of advancing the sheet metal between the punching member and the lands of the backing roller so that each punch in the punching member causes a slug of metal to be cracked out of the parent metal until one edge of said slug engages the base surface of the groove of the backing roller at a fulcrum point about which the slug pivots to cause complete separation of the slug from the parent metal.

2. The method of claim 1, wherein the punching member comprises a roller including a series of radial punches and the backing roller includes two raised annular lands defining an annular groove for each row of holes to be punched.

3. The method of claim 2, wherein the peripheral speed of the backing roller is equal to or different from that of the punches of the punching member.

4. The method of claims 1, 2, or 3, wherein the backing roller is driven by frictional engagement of the land surfaces thereof with said sheet metal.

5. The method of claims 1, 2, or 3, wherein the lands of the backing roller are spaced to define a groove substantially wider than the width of the punches and a substantially symmetrical depression around each hole is thereby formed.

6. An improved apparatus for punching holes in sheet metal of the type wherein parent sheet metal is advanced through the nip between a punching roller and a backing roller and wherein slugs are punched from the metal to form holes therein by the punch face of punches projecting from the surface of the punching roller, wherein the improvement comprises at least one groove between lands in said backing roller aligned with the punched faces and having a base surface spaced from the punch faces so that as the slugs are punched, a slug is cracked out of the parent metal until one edge of the slug bears against the base surface of the groove at a point of contact which acts as a pivot point about which the slug pivots as force is exerted by the further action of the punch sufficiently to cause the slug to be completely separated from the parent sheet metal.

7. The apparatus of claim 6, wherein the backing roller is driven by frictional engagement of the land surfaces thereof with the advancing sheet metal.

8. The apparatus of claims 6 or 7, wherein said lands are spaced from the sides of said punches to define grooves substantially wider than the width of the punches and substantially symmetrical depressions in the sheet metal around each hole are thereby formed.

9. The apparatus of claims 6 or 7, wherein the projection of said punches is adjustable.

10. The apparatus of claim 6 or 7, wherein the punching roller includes a series of radial punches and the backing roller includes annular lands defining an annular groove for each row of holes to be punched.

11. Apparatus for punching holes in sheet metal, said apparatus comprising a frame, a punching roller mounted on a shaft rotatable in said frame and carrying a plurality of punches on the cylindrical surface thereof, a backing roller mounted on a shaft rotatable in said frame and spaced sufficiently close to the cylindrical surface of the punching roller as to enable the sheet of metal to rotate the backing roller by frictional contact therewith, said backing roller having for each row of holes to be punched a groove between lands or annular rings thereon, said groove having a base disposed relative to the length of said punches and relative to said lands and said lands being spaced a distance apart substantially wider than the width of said punches so that on a sheet of metal being passed through the nip between said punching roller and said backing roller, and on said punching roller being driven, each punch punches a slug of metal so as to be cracked out of the parent metal until one edge of the slug contacts the base of said groove at a point of contact which acts as a pivot point on which the slug pivots to cause the slug to be removed completely from the parent metal by further action of the punch, with each hole being made in a substantially symmetrical depression.

12. A method of punching holes in sheet metal using a rotatable punching roller having a series of radial punches on a cylindrical surface thereof and a backing roller, the backing roller having for each row of holes to be made two raised annular lands and an annular groove therebetween, the groove having a bottom at a predetermined depth relative to said lands and said lands being spaced apart from said punches by a distance substantially wider than the width of the punches, said method comprising the steps of driving said punching roller running sheet metal through the nip between the punching roller and the backing roller so that the backing roller is frictionally driven by the sheet metal and so that each punch in the punching roller causes a slug of metal to be cracked out of the parent metal until one edge of said slug of metal engages the bottom of the groove of the backing roller at a fulcrum point whereupon the slug of metal fulcrums on said fulcrum point causing complete separation of the slug of metal from the parent metal, each hole made being in a substantially symmetrical depressed area of the sheet metal.

* * * * *